US008772218B2

(12) United States Patent
Cunningham et al.

(10) Patent No.: US 8,772,218 B2
(45) Date of Patent: Jul. 8, 2014

(54) STAIN-DISCHARGING AND REMOVING SYSTEM

(71) Applicant: Kimberly-Clark Worldwide, Inc., Neenah, WI (US)

(72) Inventors: Corey Cunningham, Larsen, WI (US); Scott W. Wenzel, Neenah, WI (US); Chris Decker, Neenah, WI (US); Jeffrey R. Seidling, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/971,929

(22) Filed: Aug. 21, 2013

(65) Prior Publication Data

US 2013/0333120 A1 Dec. 19, 2013

Related U.S. Application Data

(60) Division of application No. 12/114,614, filed on May 2, 2008, which is a continuation-in-part of application No. 11/847,549, filed on Aug. 30, 2007, now Pat. No. 7,879,744.

(51) Int. Cl.

| | |
|---|---|
| ***C11D 3/00*** | (2006.01) |
| ***C11D 17/04*** | (2006.01) |
| ***C11D 3/39*** | (2006.01) |
| ***D06L 1/12*** | (2006.01) |
| ***C11D 17/00*** | (2006.01) |
| ***C11D 3/33*** | (2006.01) |

(52) U.S. Cl.

CPC ..... *C11D 17/041* (2013.01); *C11D 17/049* (2013.01); *C11D 3/3947* (2013.01); *C11D 3/0084* (2013.01); *D06L 1/12* (2013.01); *C11D 17/003* (2013.01); *C11D 3/33* (2013.01)

USPC ..... 510/280; 8/137

(58) Field of Classification Search

USPC ..... 510/280; 8/137

See application file for complete search history.

(56) References Cited

U.S. PATENT DOCUMENTS

| | | | | |
|---|---|---|---|---|
| 3,338,992 | A | | 8/1967 | Kinney |
| 3,341,394 | A | | 9/1967 | Kinney |
| 3,494,821 | A | | 2/1970 | Evans |
| 3,502,538 | A | | 3/1970 | Petersen |
| 3,502,763 | A | | 3/1970 | Hartmann |
| 3,542,615 | A | | 11/1970 | Dobo et al. |
| 3,635,828 | A | | 1/1972 | Benjamin et al. |
| 3,692,618 | A | | 9/1972 | Dorschner et al. |
| 3,802,817 | A | | 4/1974 | Matsuki et al. |
| 3,849,241 | A | | 11/1974 | Butin et al. |
| 4,041,203 | A | | 8/1977 | Brock et al. |
| 4,100,324 | A | | 7/1978 | Anderson et al. |
| 4,130,501 | A | | 12/1978 | Lutz et al. |
| 4,144,370 | A | | 3/1979 | Boulton |
| 4,336,024 | A | * | 6/1982 | Denissenko et al. ..... 8/142 |
| 4,340,563 | A | | 7/1982 | Appel et al. |
| 4,374,888 | A | | 2/1983 | Bornslaeger |
| 4,473,507 | A | * | 9/1984 | Bossu ..... 562/2 |
| 4,640,810 | A | | 2/1987 | Laursen et al. |
| 4,663,220 | A | | 5/1987 | Wisneski et al. |
| 4,766,029 | A | | 8/1988 | Brock et al. |
| 4,900,469 | A | | 2/1990 | Farr et al. |
| 5,213,881 | A | | 5/1993 | Timmons et al. |
| 5,259,848 | A | | 11/1993 | Terry et al. |
| 5,284,703 | A | | 2/1994 | Everhart et al. |
| 5,350,624 | A | | 9/1994 | Georger et al. |
| 5,382,400 | A | | 1/1995 | Pike et al. |
| 5,451,346 | A | | 9/1995 | Amou et al. |
| 5,527,892 | A | | 6/1996 | Borsotti et al. |
| 5,540,332 | A | | 7/1996 | Kopacz et al. |
| 5,591,507 | A | * | 1/1997 | Jones ..... 428/88 |
| 5,656,302 | A | | 8/1997 | Cosentino et al. |
| 5,667,635 | A | | 9/1997 | Win et al. |
| 5,703,036 | A | | 12/1997 | Iakovides |
| 5,767,055 | A | | 6/1998 | Choy et al. |
| 5,770,543 | A | | 6/1998 | Garst et al. |

(Continued)

FOREIGN PATENT DOCUMENTS

| | | | |
|---|---|---|---|
| CN | 1212633 | A | 3/1999 |
| CN | 1496399 | A | 5/2004 |

(Continued)

OTHER PUBLICATIONS

Abstract of German Patent—DE10032589, Jan. 24, 2002, 1 page.

(Continued)

*Primary Examiner* — Nicole M Buie-Hatcher
*Assistant Examiner* — M. Reza Asdjodi
(74) *Attorney, Agent, or Firm* — Dority & Manning, P.A.

(57) ABSTRACT

A cleaning composition that can discharge the color of blood, menstrual fluids, or other organic stains is provided. In particular, the present invention achieves a balance between control of unwanted liquid spreading by lateral wicking on a stained textile fabric to lessen the size of wet spots and maintaining the cleaning efficacy of the composition by means of specific kinds of thickening agents. The composition includes an oxidizing agent such as peroxides, a cell-lysing agent, a chelating agent, an antioxidant, a thickener, and other optional ingredients that are selectively employed to achieve an aqueous based composition that exhibits good shelf stability and stain removal properties. The thickening agent may include a cellulosic or clay material, starch, gum, fatty acid, fatty alcohol, hydrophilic colloidal particles, polyoxyethylene glycol or polyoxyethylene glycol derivatives including fatty acid esters and ethers, or a combination thereof.

11 Claims, 4 Drawing Sheets

(56) References Cited

U.S. PATENT DOCUMENTS

| | | | | |
|---|---|---|---|---|
| 5,785,179 | A | 7/1998 | Buczwinski et al. | |
| 5,853,430 | A | 12/1998 | Shindo et al. | |
| 5,872,090 | A | 2/1999 | You et al. | |
| 5,888,524 | A | 3/1999 | Cole | |
| 5,895,504 | A | 4/1999 | Sramek et al. | |
| 5,900,187 | A | 5/1999 | Scialla et al. | |
| 5,900,256 | A | 5/1999 | Scoville, Jr. et al. | |
| 5,904,734 | A | 5/1999 | Friberg et al. | |
| 5,929,012 | A | 7/1999 | Del Duca et al. | |
| 5,962,112 | A | 10/1999 | Haynes et al. | |
| 5,964,351 | A | 10/1999 | Zander | |
| 5,993,792 | A * | 11/1999 | Rath et al. | 424/70.28 |
| 5,997,585 | A | 12/1999 | Scialla et al. | |
| 6,001,794 | A | 12/1999 | Del Duca et al. | |
| 6,028,018 | A | 2/2000 | Amundson et al. | |
| 6,030,331 | A | 2/2000 | Zander | |
| 6,048,368 | A * | 4/2000 | Tcheou et al. | 8/137 |
| 6,066,610 | A | 5/2000 | Sramek | |
| 6,110,883 | A * | 8/2000 | Petri et al. | 510/372 |
| 6,117,433 | A * | 9/2000 | Edens et al. | 424/400 |
| 6,158,614 | A | 12/2000 | Haines et al. | |
| 6,168,808 | B1 | 1/2001 | Hamon Godin et al. | |
| 6,171,346 | B1 | 1/2001 | Yeazell et al. | |
| 6,187,738 | B1 | 2/2001 | Micciche et al. | |
| 6,269,969 | B1 | 8/2001 | Huang et al. | |
| 6,269,970 | B1 | 8/2001 | Huang et al. | |
| 6,273,359 | B1 | 8/2001 | Newman et al. | |
| 6,277,105 | B1 | 8/2001 | Rynish | |
| 6,315,864 | B2 | 11/2001 | Anderson et al. | |
| 6,376,444 | B1 | 4/2002 | Hortel et al. | |
| 6,391,840 | B1 | 5/2002 | Thompson et al. | |
| 6,395,701 | B1 * | 5/2002 | Connor et al. | 510/437 |
| 6,420,332 | B1 | 7/2002 | Simpson | |
| 6,437,199 | B1 | 8/2002 | Oka et al. | |
| 6,440,437 | B1 | 8/2002 | Krzysik et al. | |
| 6,471,728 | B2 | 10/2002 | Smith et al. | |
| 6,494,920 | B1 * | 12/2002 | Weuthen et al. | 8/137 |
| 6,495,501 | B1 | 12/2002 | Del Duca et al. | |
| 6,524,379 | B2 | 2/2003 | Nohr et al. | |
| 6,579,838 | B2 | 6/2003 | Housmekerides et al. | |
| 6,644,879 | B2 | 11/2003 | Irvin et al. | |
| 6,653,269 | B2 | 11/2003 | Housmekerides et al. | |
| 6,689,730 | B2 | 2/2004 | Hortel et al. | |
| 6,730,819 | B1 | 5/2004 | Pesce | |
| 6,753,306 | B2 | 6/2004 | Simpson | |
| 6,790,380 | B2 | 9/2004 | Sato et al. | |
| 6,806,362 | B2 | 10/2004 | Smith et al. | |
| 6,832,867 | B2 | 12/2004 | Sandbach et al. | |
| 6,838,423 | B2 | 1/2005 | Irvin et al. | |
| 6,846,332 | B2 | 1/2005 | Boissie et al. | |
| 6,905,276 | B2 * | 6/2005 | Van Buskirk et al. | 401/265 |
| 6,946,413 | B2 | 9/2005 | Lange et al. | |
| 6,958,103 | B2 | 10/2005 | Anderson et al. | |
| 6,960,349 | B2 | 11/2005 | Shantz et al. | |
| 7,047,582 | B2 | 5/2006 | Moe et al. | |
| 7,148,187 | B1 | 12/2006 | Simon et al. | |
| 7,182,537 | B2 | 2/2007 | Policicchio et al. | |
| 7,320,956 | B2 | 1/2008 | Johnson et al. | |
| 7,390,431 | B2 | 6/2008 | Faryniarz et al. | |
| 7,442,678 | B2 | 10/2008 | Sandbach et al. | |
| 7,459,496 | B2 | 12/2008 | Hsu et al. | |
| 7,462,590 | B2 | 12/2008 | Tichy et al. | |
| 7,879,744 | B2 | 2/2011 | Seidling et al. | |
| 8,110,538 | B2 | 2/2012 | Martin et al. | |
| 8,318,654 | B2 | 11/2012 | Hoffman et al. | |
| 2002/0174500 | A1 | 11/2002 | Micciche et al. | |
| 2003/0109411 | A1 | 6/2003 | Kilkenny et al. | |
| 2003/0119209 | A1 | 6/2003 | Kaylor et al. | |
| 2004/0231061 | A1 | 11/2004 | Irvin et al. | |
| 2005/0026802 | A1 | 2/2005 | Kilkenny et al. | |
| 2005/0159063 | A1 * | 7/2005 | Hill et al. | 442/327 |
| 2006/0008621 | A1 | 1/2006 | Gusky et al. | |
| 2006/0204530 | A1 | 9/2006 | Ramirez et al. | |
| 2007/0001145 | A1 | 1/2007 | Faryniarz et al. | |
| 2007/0167342 | A1 * | 7/2007 | Van Asten et al. | 510/302 |
| 2009/0062172 | A1 * | 3/2009 | Cunningham et al. | 510/281 |

FOREIGN PATENT DOCUMENTS

| | | | |
|---|---|---|---|
| EP | 0843001 | A1 | 5/1998 |
| EP | 1059032 | A1 | 12/2000 |
| EP | 1700907 | A1 | 9/2006 |
| GB | 2397823 | A | 8/2004 |
| JP | 7082592 | A | 3/1995 |
| WO | WO 9963042 | A1 | 12/1999 |
| WO | WO 2004067194 | A2 | 8/2004 |
| WO | WO 2009076334 | A1 | 7/2006 |

OTHER PUBLICATIONS

Abstract of Japanese Patent—JP2000144200, May 26, 2000, 2 pages.

Machine Translation of Japanese Patent—JP H07-08252 (D7), 15 pages.

Supplementary European Search Report, Nov. 29, 2012, 9 pages.

"Aerosol® OT Surfactants," (Sodium Doctyl Sulfosuccinate) product information, Cytec Industries, Inc., West Paterson, NJ, 2000, 6 pages.

Friedman et al., *Field Guide to Stains: How to Identify and Remove Virtually Every Stain Known to Man*, Quirk Publications, Inc., 2002, pp. 199-202.

"Seeing Spots? Don't Rely on Quick Stain Removers," *Consumer Reports*, Aug. 2006, p. 9.

"Stain Removers: Which are Best," *Consumer Reports*, Mar. 2000, p. 52.

"Synthrapol," Internet web pages "http://www.pburch/net/dyeing/FAQ/synthrapoi.shtml," Jan. 4, 2008, pp. 1-5.

* cited by examiner

Fig. 3A – Inventive composition and method after about 1/30 minutes cleaning time
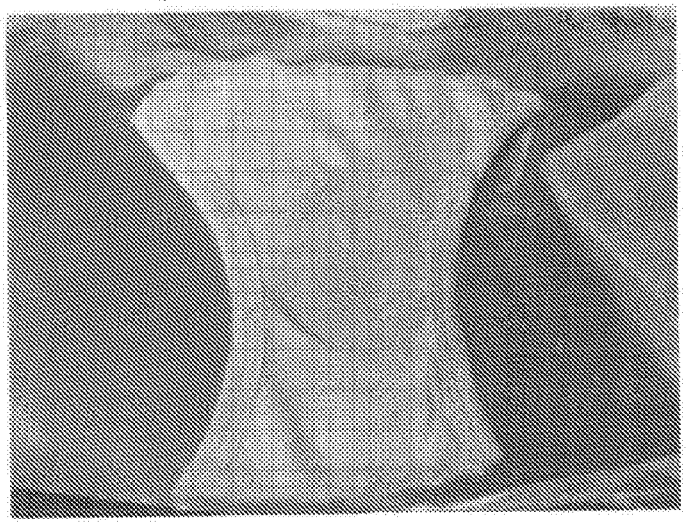
Fig. 3B – Competitive product #1 after use according to manufacturer's directions for 3 minutes
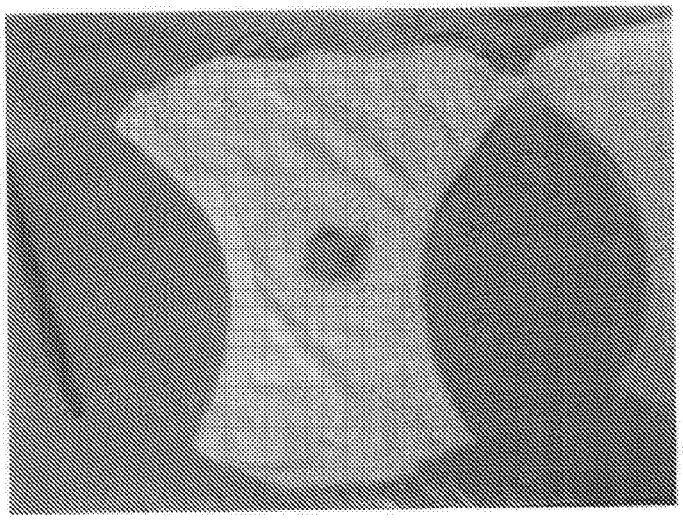

Fig. 3C – Competitive product #2 after use according to manufacturer's directions for 3 minutes
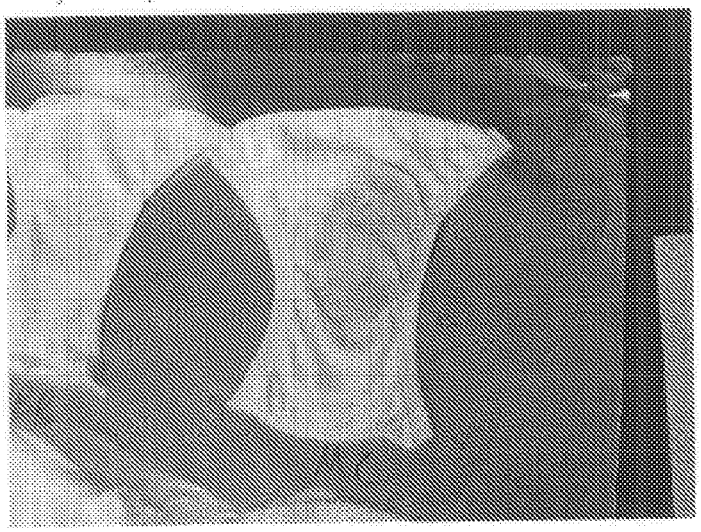
Fig. 3D – Competitive product #4 after use according to manufacturer's directions for 3 minutes
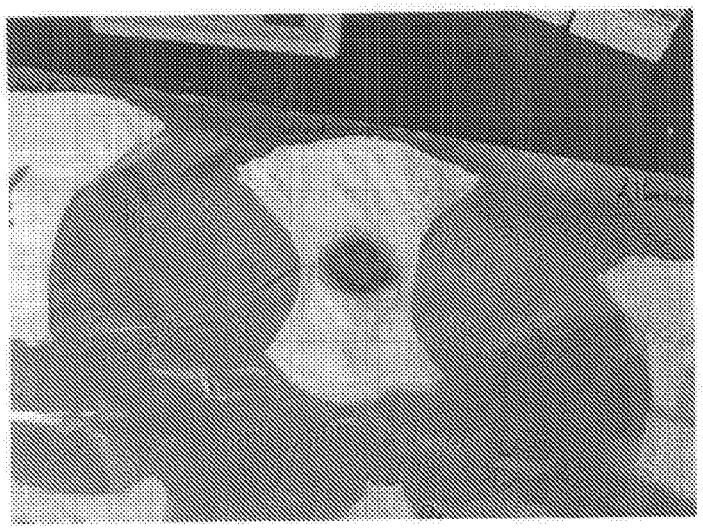

STAIN-DISCHARGING AND REMOVING SYSTEM

RELATED APPLICATIONS

The present application is related to U.S. patent application Ser. No. 11/847,549, filed on Aug. 30, 2007. The present application is a divisional of U.S. application Ser. No. 12/114,614, filed on May 2, 2008, which is incorporated herein in its entirety by reference thereto.

FIELD OF INVENTION

The present invention pertains to a product assembly or kit and method for decolorizing or neutralizing various organic colorants and stains. In particular, the invention describes a cleaning kit and stain removing reaction mechanism that targets organic colorant systems. The present invention also speaks to an improved formulation for a stain-discharging solution having at least one kind of thickener and exhibiting a controlled liquid flow when applied to a stained textile substrate.

BACKGROUND

Traditionally, blood is regarded as among the most difficult kinds of stain, along with ink and grease, to clean and remove. Removing blood stains, for example, from clothing is an arduous and timely process where care has to be used so as not to set the stain into the fabric permanently. The typical process involves rinsing the fabric with cold salt water (not hot water as this would set the stain into the fabric making it almost impossible to remove). Next, the fabric is soaked in cold water containing an enzyme-based detergent or meat tenderizer for about 30-60 minutes. One would then apply a laundry pre-soak and then launder with enzyme-based detergent. (See e.g., Field Guide to Stains, pp. 199-202, Quirk Publications, Inc. ©2002) This course of treatment can be truly a time consuming process and is not conducive to portable, or outside the home, use.

Recent stain removers use an oxidizing method for removing blood stains, for example, applying an oxidizing agent to the stained area. U.S. Pat. No. 6,730,819 claims the use of oxidizing agents, including oxides, peroxides, ozonides, and superoxides. Most of these agents are irritants or caustic to human skin and therefore not suitable for use in various consumer products, such as feminine hygiene pads or other applications that contact skin. In a series of studies, Consumer Reports, a leading U.S. publication for consumer products, evaluated currently available commercial spot and stain-removers and found that they either do not work effectively against or are not recommended for blood, ink or grease spots or stains. (See, Consumer Reports, *"Seeing Spots? Don't Rely on Quick Stain Removers,"* p. 9, August 2006; Consumer Reports, *"Stain Removers: Which are Best,"* p. 52, March 2000; and Consumer Reports *"On-the-Spot Cleanup,"* p. 10, June 1998.) Some of the commercial spot and stain removers state explicitly on their packaging "not effective on blood, ink and grease."

Currently, given the absence of a viable composition or commercial product, a need exists for a better kind of stain remover, especially one that works well on blood, ink, or grease, among other colorants or stains. Workers in various different industries, such as relating to household or industrial cleaning, laundry, textiles, cosmetics, or health and hygiene, will appreciate a stringent, but less caustic stain removing formulation that can neutralize or discharge various kinds of colorants at a relatively rapid rate. The formulation may be applied to articles that can contact bare skin or on a variety of different materials and in a variety of products without harmful effects.

SUMMARY OF THE INVENTION

The present invention pertains to a method and product system for actively removing or discharging an organic colorant or stain, such as blood or menstrual fluid. The method involves providing a textile substrate that has an organic colorant or stain on a first facing; applying an absorbent substrate against a side of the textile substrate, either directly in contact with the stain on the first facing or on a second facing behind or opposite from the stain; treating with a stain-discharging composition the side of the textile substrate opposite of the absorbent substrate, such that the stain-discharging composition and stain are drawn through the textile substrate into the absorbent substrate. The stain-discharging composition decolorizes and solvates the stain material to allow it to be drawn through the fibers of the textile into the absorbent substrate. As the stain-discharging composition is placed on the stain, the wicking action of the stained textile draws the solution horizontally across the textile substrate, creating a wet spot on the textile. At the same time, the solution is being drawn along the vertical axis through the plane of the textile sheet by the capillary action of the absorbent substrate. It is believed that capillary action of the absorbent substrate draws the stain-discharging composition through the stained textile fibers and the plane of the textile sheet, into the absorbent substrate. Typically, the stain undergoes a detectable change in color within about 30 minutes or less after contact with the decolorizing composition.

In another aspect, the present invention also pertains to a stain-removing kit that can be used to practice the method outlined above. The kit or assembly includes a number of absorbent substrates that are adapted to draw moisture away from a treated stain area, a dispenser containing a stain-discharging composition with an aqueous based or polar solvent medium; and a stain-agitating device, which is configured either separately from or as an integrated part of the dispenser. The solvent medium can be in any form that easily dispenses from the dispenser, but typically could be in the form of a liquid, gel, or semi-solid. The absorbent substrates are formed from at least one or a combination of the following: a paper toweling material, an absorbent cellulose-based fabric, an absorbent sponge or foam, a nonwoven fabric basesheet material, or a superabsorbent material, or an absorbent with a non-liquid permeable backing, or any other absorbent substrate. Alternatively, the absorbent substrates can be formed from at least one of the following or combinations thereof in a laminated form: a) a cellulose airlaid fabric with about 50-60% of a superabsorbent homogeneously mixed therein, b) a cotton cellulose spunlace fabric, or c) cotton quilted squares. One may further physically agitate the stained area either during or after the treating step, either manually by rubbing or using a scrubbing device, tool or other mechanism. The stain may be situated between the absorbent substrate and a direction from which treatment is applied.

In yet another aspect, the present invention includes an aqueous based stain-discharging composition that has a viscosity of between about 10 cP and about 150,000 cP. The stain-discharging composition has an oxidizing agent, at least one cell-lysing agent, at least one chelating agent, at least one antioxidant, a thickening agent, and a polar solvent. The oxidizing agent can be hydrogen peroxide or any other compound capable of controlled release of hydrogen peroxide.

The peroxide is in an amount from about 0.10 wt. % to about 10 wt. %. The composition also includes from about 0.1 wt. % to about 10 wt. % of the cell lysing agent, such as a surfactant, from about 0.05 wt. % to about 10 wt. % of the chelating agent, from about 0.0005 wt. % to about 5 wt. % of the antioxidant, and from about 50 wt. % to about 99.9 wt. % of the polar solvent, such as water. Additionally, the composition includes a thickening agent from about 0.001 wt. % to about 10 wt. % to control the flow rate and dispersion of the stain-discharging composition when applied to a stain on either woven or nonwoven textile substrate. The composition, for example, may maintain about 70% or more, in some embodiments about 80% or more, and in some embodiments, about 90% or more of its initial hydrogen peroxide ($H_2O_2$) content subsequent to being aged at ambient temperature (~25° C.) for 2 weeks.

According to another embodiment, the present invention relates to a wipe that comprises a nonwoven web and an aqueous based stain-discharging composition, such as listed above, that constitutes from about 150 wt. % to about 600 wt. % of the dry weight of the wipe. The wipe material may, according to certain embodiments, be used as a scrubbing substrate to mechanically agitate against a stain and also be applied as a blotter-like absorbent substrate material.

Other features and aspects of the present invention are discussed in greater detail below.

BRIEF DESCRIPTION OF FIGURES

FIG. 3 shows a series of photos comparing the relative speed and effectiveness of removing an organic stain from cotton undergarments, each of which have been similarly stained with blood. FIG. 3A shows a garment after being treated with an embodiment of the present stain-discharging composition and cleaned according to the method described herein for under three minutes. FIGS. 3B through 3D are garments each treated with a commercially available competitive "on-the-go" stain removing product and cleaned according to the manufacturer's suggested methods for up to about three minutes.

DETAILED DESCRIPTION OF THE INVENTION

Section I.—Definitions

Figure 1:
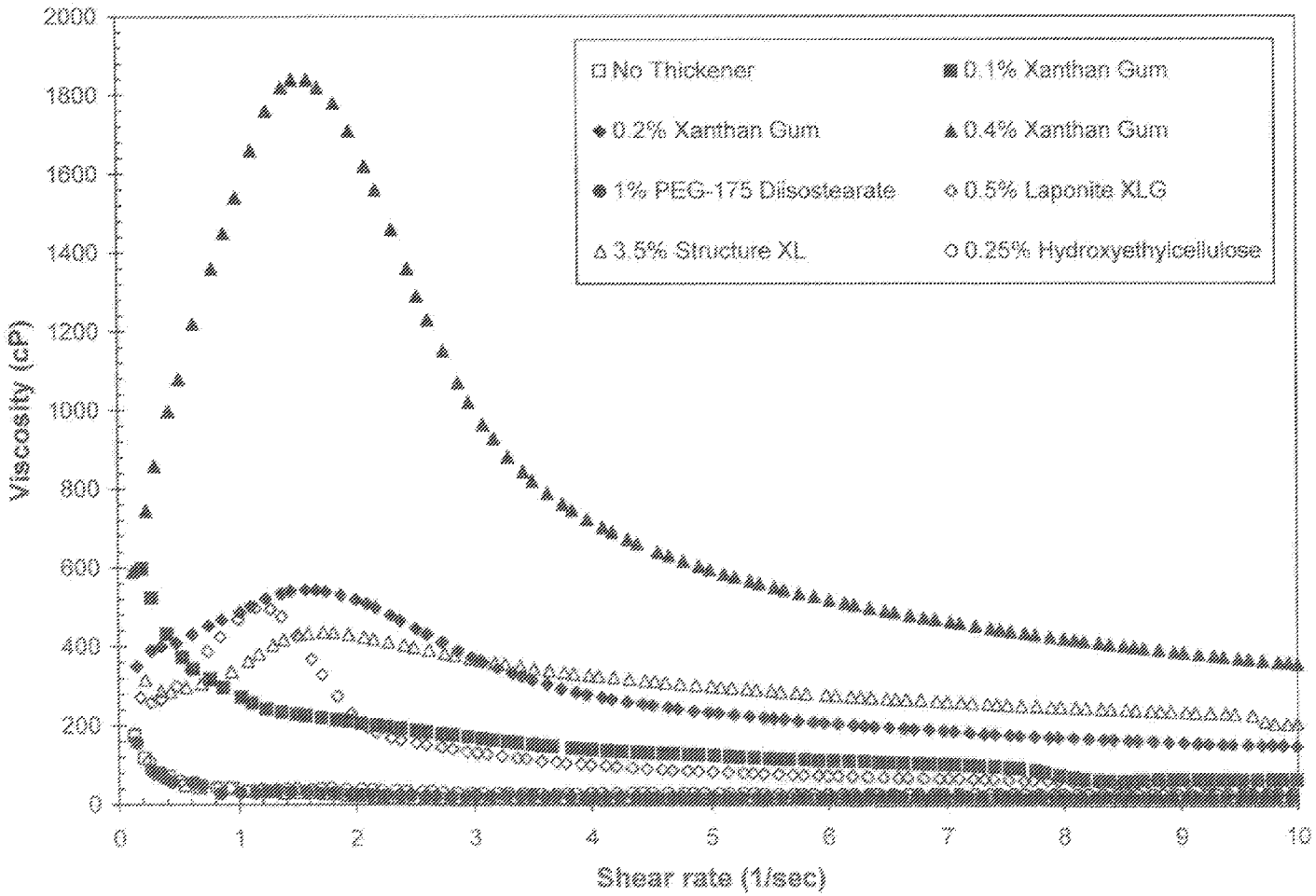
FIG. 1, is a graph illustrating the relative rheology profiles of certain examples of formulations for a stain-discharging medium according to the present invention. These compositions contain thickening agents that exhibit good chemical and physical stability for storage of the medium, as well as an initial viscosity when first applied that provides good flow control, and maintains its cleaning power and stain-discharging efficacy.

As used herein the term "nonwoven web" refers generally to a web having a structure of individual fibers or threads which are interlaid, but not in an identifiable manner as in a knitted fabric. Examples of suitable nonwoven webs include, but are not limited to, meltblown webs, spunbond webs, carded webs, airlaid webs, etc. The basis weight of the nonwoven web may vary, such as from about 10 grams per square meter (gsm) to about 200 gsm, in some embodiments from about 15 gsm to about 170 or 180 gsm, and in some embodiments, from about 15 gsm to about 125 or 135 gsm.

As used herein, the term "meltblown web" generally refers to a nonwoven web that is formed by a process in which a molten thermoplastic material is extruded through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that are substantially continuous or discontinuous, generally smaller than 10 microns in diameter, and generally tacky when deposited onto a collecting surface.

As used herein, the term "spunbond web" generally refers to a web containing small diameter substantially continuous fibers. The fibers are formed by extruding a molten thermoplastic material from a plurality of fine, usually circular, capillaries of a spinnerette with the diameter of the extruded fibers then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers may sometimes have diameters less than about 40 microns, and are often between about 5 to about 20 microns.

As used herein, the term "carded web" refers to a web made from staple fibers that are sent through a combing or carding unit, which separates or breaks apart and aligns the staple fibers in the machine direction to form a generally machine direction-oriented fibrous nonwoven web. Such fibers are usually obtained in bales and placed in an opener/blender or picker, which separates the fibers prior to the carding unit. Once formed, the web may then be bonded by one or more known methods.

As used herein, the term "airlaid web" refers to nonwovens formed by airlaying processes, which involves bundles of fibers having typical lengths ranging from about 3 to about 19 millimeters (mm). The fibers are separated, entrained in an air supply, and then deposited onto a forming surface, usually with the assistance of a vacuum supply. Once formed, the randomly deposited fibers are bonded to one another by one or more known methods, for example, hot air or a spray adhesive. Airlaying is described in, for example, U.S. Pat. No. 4,640,810, to Laursen et al.

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 (152×0.89×0.00707=1.415). Outside the United States the unit of measurement is more commonly the "tex", which is defined as the grams per kilometer of fiber. Tex may be calculated as denier/9.

As used herein, "coform" is intended to describe a blend of meltblown fibers and cellulose fibers that is formed by air forming a meltblown polymer material while simultaneously blowing air-suspended cellulose fibers into the stream of meltblown fibers. The meltblown fibers containing wood fibers are collected on a forming surface, such as provided by a foraminous belt. The forming surface may include a gas-pervious material, such as spunbonded fabric material, that has been placed onto the forming surface.

As used herein, the term "thickener" or "thickening agent" refers to ingredients used to increase the viscosity of aqueous or polar based solvents. Their ability to perform this function is related to their solubility in polar based solvents, such as water.

Section II.—Detailed Description

Traditionally, strong oxidizing agents such as peroxide have been used to bleach or decolorize stains, but most peroxides are difficult to use as they are unstable and decompose when in polar solutions, or exposed to heat, light, metal cations or halides. The present invention relates to a cleaning system which quickly decolorizes and removes stains from the surfaces of textile fabrics used in clothing without bleaching any dyes on the textile. For instance, the present product can be employed, with an applicator and an absorbent substrate, in various fields, such as for health care settings to effectively remove blood on surgical textiles such as gowns, caps, linens, or by the consumer at home for various stain removal uses.

Generally speaking, the present invention is directed to a decolorizing composition that can discharge the color of blood, menstrual fluid, or other difficult stains. More specifically, a peroxide, cell lysing agent, chelating agent, antioxidant, polar solvent, thickener, and other optional ingredients are selectively employed to achieve an aqueous composition that exhibits good shelf stability and stain removal properties. The composition, for example, may maintain about 70% or more, in some embodiments about 80% or more, and in some embodiments, about 90% or more of its initial hydrogen peroxide ($H_2O_2$) content subsequent to being aged at ambient temperature (~25° C.) for 2 weeks.

By refining the chemical characteristics of the stain cleaning solution, the present invention advances beyond previous research and has achieved certain surprising results. The present invention reduces the wicking of the composition along the textile fabric resulting in a smaller wet spot and less water in the textile and overcomes the problems and disadvantages associated with previous aqueous based stain-discharging compositions, such as issues described in U.S. patent application Ser. No. 11/847,549, the content of which is incorporated herein by reference. The present invention builds upon the formulation for a stain-discharging solution that has peroxide, a cell-lysing agent, and a chelating agent, by the addition of viscosity enhancing agents that reduce the spreading or wicking properties of the stain-discharging solution across the fibers of a textile. The present invention is able to maintain the cleaning efficacy of the composition while providing the additional benefit of less textile wetting during the stain removal process. A more viscous stain-discharging product reduces the relative concentration of water remaining in the textile during stain removal by minimizing the wicking action of the solution across the textile. Overall this will result in a more controlled and smaller area becoming wet during stain discharge and a lower overall wetness level on the textile to which a consumer applies the cleaning solution. This benefit is desirable for consumers "on the go," who experience a stain on clothing that needs to be worn immediately after stain removal, such as menstrual fluid leakage on pants or underwear. In this example, the more viscous stain-discharging solution enables the consumer to quickly remove the stain and wear the treated garment again due to the lower overall wetness of the textile.

Relative to other solutions which contain peroxides, the stain-discharging compositions of the present invention can be used in a convenient on-the-go type of applicator product form. Previously, for instance, when cleaning menstrual fluid stains on underwear, the stain removing composition, because of its relatively low viscosity (<9 or 10cP) liquid-based formulation, tends to spread to a very large area when applied to a cotton textile material. Even when the stain is a very small spot, the cleaning solution can cause the wetted area of the removed stain to spread to a much larger area, causing the underwear to be very wet, causing the consumer to not want to wear their underwear again; thus, defeating the on-the-go advantages of the product.

It is desired that a consumer can clean the underwear by a localized application of the stain-discharging product, only wetting the relatively small area affected by the stain. This allows the consumer to wear the underwear soon after application of the stain-discharging product. The addition of viscosity increasing agents limits significantly the spreading of the cleaning solution along the textile fibers but does not impede the flow of the composition through the textile into the absorbent substrate. This approach to increase the viscosity and slow the rate of spreading of the stain-discharging solution may appear at first to be conventional but as we have discovered the selection and inclusion of the right kind of thickening agent is far from obvious.

Although the use of thickeners have been employed in other formulations for improving the relative viscosity of an aqueous detergent composition, such as in U.S. Pat. No. 5,703,036 (Iakovides), the functional distinction between such compositions and the presently disclosed compositions has to do with the fact that not all of the thickened formulations were able to both prevent wicking and still maintain cleaning efficacy within the specified time constraints (e.g., within about one hour, desirable within about 30 minutes). Although some viscosity increasing ingredients are effective at preventing the spreading of the cleaning solution, they can also prevent effective cleaning. We have discovered certain viscosity increasing agents that can both prevent the spread of the cleaning solution, and still clean very efficiently. Generally, we have found that the carbomer and acrylate-thickeners do not clean well at all. Formulations like those by Iakovides might show some reduced wicking, but surfactants alone will not clean difficult to remove organic stains such as blood or other blood-based stains. The presence of antioxidants, peroxide and chelating agents are necessary to totally discharge the stain. Both aspects must be solved in order to deliver an effective product.

Additionally, thickened peroxide compositions have been disclosed, such as those referenced in U.S. Pat. No. 4,130,501 (Lutz, et al.). Formulations disclosed by Lutz, et al. utilize a surfactant but long-term stability of the thickened composition was achieved by thickening specifically with carbopol resins as other thickeners either did not thicken or did not maintain long-term stability of the composition. In contrast, the present invention has shown acrylates, such as carbopol, to be effective at preventing wicking of the solution across the substrate but ineffective at cleaning the stain quickly and efficiently. Other thickening agents were shown to maintain both a low wicking rate across the substrate and an effective cleaning of the stain.

According to the present invention, at ambient room temperature (~18-25° C.), the compositions that have performed well with a thickening agent generally have a viscosity in the range of between at least about 10 cP to about 150,000 cP. More typically the viscosity is in a range from about 13 or 15 cP to about 25,000 cP. In certain embodiments, the viscosity desirably is within a range of about 20 cP to about 4,600-5,000 cP, and desirably from about 20 or 25 cP to about 3,500 or 4,000 cP. Certain preferred embodiments exhibit a viscosity of about 75 or 80 cP to about 600 cP. These values are expressed in terms of viscosity at 5/sec, as viscosity is measured as a function of shear rate in units of inverse seconds ($sec^{-1}$).

Figure 2:
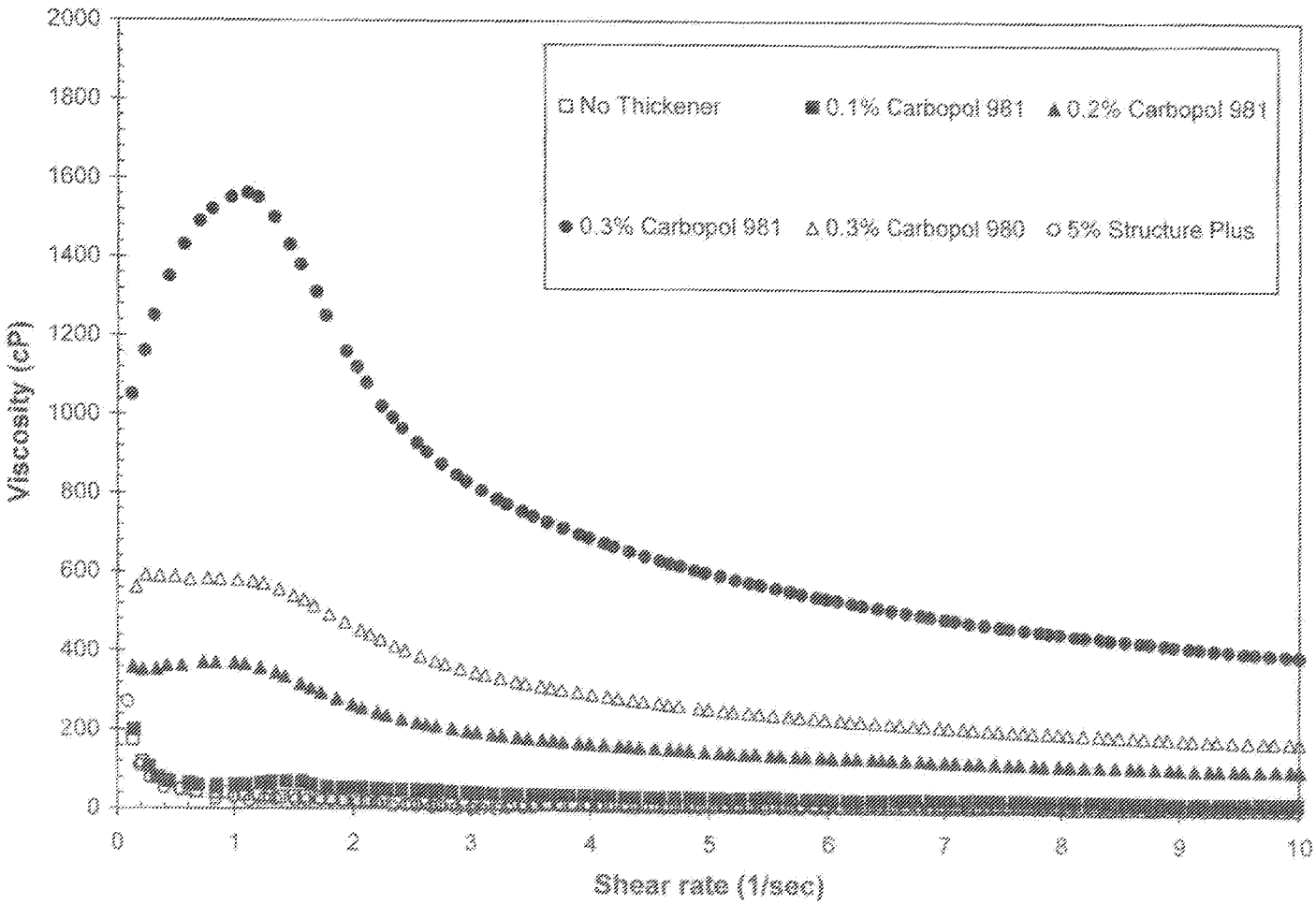
FIG. 2, is a graph of the rheology profiles of some comparative formulations that contain thickening agents, but which did not perform well in maintaining cleaning efficacy.

FIGS. 1 and 2, graph the viscosity of certain examples of the cleaning formulation as described herein. FIG. 1 shows the rheology profile for certain examples that contain thickening agents that increase viscosity while maintaining the efficacy of the cleaning formulation. In comparison, FIG. 2 illustrates the rheology profile of compositions that contain thickening agents that retard or interfere with the cleaning power of the formulation. A mere comparison of the rheology profiles would not lead one to conclude the present invention to be obvious. Rather, the differences that distinguish between inventive formulations from those that were found to be lacking in their performance are not evident by a change in the rheology of a formulation. Rather, the difference was related to the ability of a formulation to exhibit both minimal lateral spreading and rapid cleaning and organic stain removing capability. The distinction between exhibiting both good cleaning and minimal wicking attributes for a successful formulation versus an unsuccessful one is believed to be related to its relevant composition.

The thickening agent is present in an amount in the range from about 0.001 wt. % to about 10 wt. %. More typically, the amount is from about 0.01 wt. % to about 5 wt. %. The inventors have identified that acrylate based thickeners were not effective at providing both anti-spreading attributes while maintaining cleaning efficiency. Specifically, acrylate based thickeners were found to stop wicking of the stain-discharging solution, but did not exhibit effective cleaning. Examples of acrylate based thickeners include Carbopol 980 polymer, Carbopol 940 polymer (INCI designation: carbopol) available from Lubrizol/Noveon Consumer Specialties (Cleveland, Ohio), Ultrez 10, Ultrez 21 (INCI designation: acrylates/C10-30 alkyl acrylate crosspolymer) available from Lubrizol/Noveon Consumer Specialties (Cleveland, Ohio) and Structure Plus (INCI designation: acrylates/aminoacrylates/C10-30 alkyl PEG-20 itaconate copolymer) available from National Starch Chemical Company (Bridgewater, N.J.).

A number of thickeners have been found that provide both anti-spreading attributes while maintaining cleaning power. Examples of preferred non-acrylate thickeners include, but are not limited to clay, starch, cellulose, gum, fatty acid, fatty alcohol, colloidal particles, polyoxyethylene glycol derivatives, or other non-acrylate based water soluble polymeric thickeners.

According an embodiment of the invention, clay particles may be added to the stain-discharging composition as the thickening agent. The clay particles may comprise, for instance, any suitable phyllosilicate material. The clay particles, for instance, can generally have a particle size of less than about 2 microns. Clays that are particularly well suited for use in the present disclosure include colloid forming clays that are either natural clays or synthetic clays. Particular examples of clays that may be used include laponite, montmorillonite including bentonite clays, hectorite clays, attapulgite clays, smectite clays, saponite clays, mixtures thereof, and the like.

In one particular embodiment, the thickening agent may comprise laponite clay, such as Laponite XLG (INCI designation: sodium magnesium silicate) available from Southern Clay Products, Inc. (Gonzales, Tex.). Laponite XLG is a synthetic, layered clay, similar to natural smectites.

In another embodiment, the thickening agent may comprise a starch, which includes starch derivates. Starches are generally available from plants, such as corn, rice or tapioca and comprise a complex carbohydrate. Starch derivatives generally include starches that have been hydrolyzed into simpler carbohydrates by acids, enzymes, or a combination of the two.

In one particular embodiment, the thickening agent may comprise a starch, such as Structure XL (INCI designation: hydroxypropyl starch phosphate) available from National Starch Chemical Company (Bridgewater, N.J.).

Another example of a thickening agent that may be used in the present disclosure includes cellulose materials, particularly modified cellulose. Modified cellulose is generally referred to cellulose where the hydroxyl groups of the cellulose are partially or fully reacted with various chemicals. Modified celluloses include cellulose esters and cellulose ethers. Cellulose suspending agents particularly well suited for use in the present disclosure include ethyl cellulose, hydroxypropyl cellulose, carboxymethyl cellulose, hydroxypropyl methyl cellulose, hydroxyethyl methyl cellulose, hydroxyethyl cellulose, and combinations thereof.

In still another embodiment, the thickening agent may comprise a natural gum. Natural gums well suited for use in the present disclosure include guar gum, carrageenan, gum Arabic, locust bean gum, xanthan gum, and mixtures thereof. Natural gums also include any derivatives of the above gums. For instance, hydroxypropyl guar gum may also be used.

In still another embodiment, the thickening agent may comprise hydrophilic colloidal particles. Hydrophilic colloidal particles well suited for use in the present disclosure include microcrystalline cellulose, fumed silica, silica, hydrated silica, and mixtures thereof. Specifically, the thickening agent may be Cab-o-sil M5 (INCI designation: fumed silica) available from Cabot Corporation (Tuscola, Ill.). Another example is Avicel 591 (INCI designation: microcrystalline cellulose and cellulose gum) available from FMC Corporation (Philadelphia, Pa.).

Another class of thickening agents that may be used in the present disclosure include fatty acids and fatty acid alcohols. Fatty acids that may be used, for instance, include aliphatic fatty carboxylic acids having from about 8 carbon atoms to about 22 carbon atoms in the carbon chain, such as from about 10 carbon atoms to about 20 carbon atoms in the carbon chain. The aliphatic radical may be saturated or unsaturated and may be straight or branched. Mixtures of fatty acids may be also be used such as those derived from natural sources such as tallow fatty acid, coco fatty acid, soya fatty acid, and the like. Synthetically available fatty acids may also be used.

Particular examples of fatty acids which can be used include decanoic acid, lauric acid, dodecanoic acid, palmitic acid, myristic acid, stearic acid, oleic acid, eicosanoic acid, tallow fatty acid, coco fatty acid, soya fatty acid, and mixtures thereof.

As used herein, fatty acids include the polyvalent metal salts of the above fatty acids. Polyvalent metals that may be used to form the salts include, for instance, magnesium, calcium, aluminum, and zinc.

Fatty alcohols that may be used as a thickening agent include alcohols of any of the above described fatty acids. In one particular embodiment, for instance, the fatty alcohol may have the following formula:

$$RCH_2OH$$

wherein R is an alkyl group having from about 7 carbon atoms to about 19 carbon atoms, such as from about 9 carbon atoms to about 17 carbon atoms. Fatty alcohols also include those fatty alcohols that have been alkoxylated. For instance, a fatty alcohol containing from about 6 to about 22 carbon atoms in the carbon chain can be alkoxylated with ethylene oxide. The ethylene oxide may be present in an amount from about 5 moles to about 90 moles.

Particular examples of fatty alcohols that may be used include tauryl alcohol, oleyl alcohol, stearyl alcohol, cetyl alcohol, cetearyl alcohol, behenyl alcohol, and the like.

In still another embodiment, the thickening agent may comprise a polyoxyethylene glycol fatty acid ester or a polyoxyethylene glycol ether. For example, the thickening agent may comprise a polyoxyethylene glycol fatty acid of glycerol or a polyoxyethylene glycol ether of a diester of methyl glucose and a fatty acid. Particular examples include PEG-150 distearate, PEG-150 diisostearate, PEG-150 pentaerythrityl pentastearate, PEG-7 glyceryl cocoate, PEG-30 glyceryl cocoate, PEG-12 glyceryl laureate, PEG-20 glyceryl oleate, PEG-120 methyl glucose dioleate, PEG-20 methyl glucose distearate, PEG-80 methyl glucose laureate, PEG-20 methyl glucose sesquistearate, and mixtures thereof.

In one particular embodiment, the thickening agent may comprise a polyethylene glycol diester, such as Ethox HVB ((INCI designation: PEG-175 diisostearate) available from Ethox Chemicals, Inc (Greenville, S.C.). Ethox HVB is the polyethylene glycol diester of isostearic acid.

A—Composition

Reference now will be made in detail to various embodiments of the invention, one or more examples of which are set forth below. Each example is provided by way of explanation of the invention, not a limitation of the invention.

In our effort to limit the tendency for the stain-discharging composition to spread and to control the final size of the wetted area caused by the composition, while also maintaining its cleaning power, we produced several example formulations. The data are summarized in the accompanying Table A, where inventive Examples 1-4 demonstrated the best observed cleaning performance, Examples 5-11, the next best, and Examples 12 and 13, a medium-level of cleaning efficacy. Examples 14-19, did not perform well when compared to the others. Comparative Example A is a formulation derived from the composition described in U.S. Patent application Ser. No. 11/847,549.

We discovered that not every kind of thickener will work well at reducing spreading and while also maintaining color-discharge and cleaning efficacy. Using a variety of thickening agents to increase the viscosity of the cleaning solution, we tested the spreading characteristics of the solution on cotton underwear. Certain kinds of thickener additives were found to make cleaning more difficult. Thickeners that we have found not to be effective include acrylate-based thickeners, such as carbomer (carbopol 980 polymer, carbopol 940 polymer available from Noveon), acrylates C10-30 alkyl acrylate crosspolymer (Ultrez 10, Ultrez 21 available from Noveon) and acrylates/aminoacrylates/C10-30 alkyl PEG-20 itaconate copolymer (Structure Plus available from National Starch. For example, we first incorporated acrylate based thickeners (e.g., Ultrez 21), as in Example 19, to increase the viscosity of the stain-discharging solution and tested the spreading characteristics. Initially, we found that the thickener did reduce spreading, but unfortunately the additive made the color-discharge and cleaning difficult. Although not to be bound by theory, one possible explanation for the relative poor effectiveness of carbomer molecules in the formulation at cleaning maybe that carbomers counter the effective reaction of the peroxide molecules. The acrylate based thickeners, it is believed, create a barrier layer that prevents the active peroxides from interacting with the stain material.

Hence, merely thickening the formulation would not be an obvious solution to the viscosity problem presented. Further work with alternative thickeners led us to discover that cellulosic thickeners, clays, and starches worked better to both reduce lateral spreading and exhibit good stain-discharging and cleaning power. In certain embodiments, amounts of cellulosic thickeners may range from about 0.025% to about 0.35% or 0.45%, more typically between about 0.05% and 0.25% or 0.3%, inclusive. For instance, in Table A, successful composition Examples 1, 2, and 10, which incorporated xanthan gum at a concentration range of about 0.1-0.25%. This formulation both cleaned well and reduced lateral spreading of the cleaning solution. When using a clay material, the amount of thickener may be present in a range from about 0.05% to about 3.5%, desirably about 0.5% to about 2.5% or 3.0%. Starches may be present in an amount from about 1.0% to about 5.0%, typically between about 1.5% to about 3.5%, desirably about 2.0% to about 3.0%.

Also summarized in Table A, examples of inventive formulations containing an appropriate amount of thickening agents are able to reduce the size of a wet spot created by the spreading of a 1 ml drop of cleaning solution applied to the textile substrate by a factor of at least about 1.4, in comparison to a solution without a thickener. Typically, the wet spot area spreading is reduced by a factor between about a 1.7 to about 8 or 10. In certain embodiments, the wet spot area spreading is reduced by a factor of about 2 to about 7, and desirably by about 2.3 to about 6.1 or 6.5. The amount of wetted surface area cleaned using the present thickened compositions can be reduced by a factor of 2.3 to about 25.5, when compared to a solution without a thickener. Typically, the cleaned wetted surface area can be reduced by a factor of about 2.7 to about 20, more typically by a factor of about 4.7 or 5.9 to about 10.5 or 15.7, inclusive. By means of visual observation, relative effectiveness of stain removal and cleaning within about 3 minutes after stain treatment is ranked along a scale value from 1 to 5, wherein 1 represents the worst and 5 the best. The formulations of the inventive composition rank in the 3-5 range. More desirable embodiments exhibit typically a cleaning effectiveness represented in the range of 4 and 5.

The stain-discharging composition may be formed from a peroxide releasing compound when present in an aqueous or polar solution. Suitable hydrogen peroxide sources may include, for example, peroxides of alkali and alkaline earth metals, organic peroxy compounds, peroxy acids, pharmaceutically-acceptable salts thereof, and mixtures thereof. Peroxides of alkali and, alkaline earth metals include lithium peroxide, potassium peroxide, sodium peroxide, magnesium peroxide, calcium peroxide, barium peroxide, and mixtures thereof. Organic peroxy complexes may also be employed, such as carbamide peroxide (also known as urea peroxide), glyceryl hydrogen peroxide, alkyl hydrogen peroxides, dialkyl peroxides, alkyl peroxy acids, peroxy esters, diacyl peroxides, benzoyl peroxide, and monoperoxyphthalate, and mixtures thereof. Peroxy acids and their salts include organic peroxy acids such as peracetic acid, performic acid, and other alkyl peroxy acids, and monoperoxyphthalate and mixtures thereof, as well as inorganic peroxy acid salts such as persulfate, dipersulfate, percarbonate, perphosphate, perborate and persilicate salts of alkali and alkaline earth metals such as lithium, potassium, sodium, magnesium, calcium and barium, and mixtures thereof.

Regardless of its form, the decolorizing composition typically contains from about 0.1 wt. % to about 10 wt. %, in some embodiments from about 0.2 to about 6 wt. %, in some embodiments from about 0.4 wt. % to about 5 wt. %, and in some embodiments, from about 0.5 wt. % to about 4 wt. % of the peroxide. It should be understood that the above concentration is the initial concentration of the peroxide immediately following formation of the composition. Because peroxides are known to decompose in water, however, the concentration may vary over time. For example, urea peroxide dissociates into urea and hydrogen peroxide in an aqueous solution. The hydrogen peroxide may further decompose into water and oxygen. Regardless, one benefit of the present invention is that the peroxide may be sufficiently stabilized so that the peroxide content of the solution may be maintained at substantially the same level for a certain period of time. For example, the hydrogen peroxide content after being aged at room temperature (~25° C.) for 2 weeks may still be from about 0.1 wt. % to about 10 wt. %, in some embodiments from about 0.2 to about 6 wt. %, in some embodiments from about 0.4 wt. % to about 5 wt. %, and in some embodiments, from about 0.5 wt. % to about 4 wt. %.

A cell lysing agent is also employed in the decolorizing composition in an amount from about 0.1 wt. % to about 10 wt. %, in some embodiments from about 0.5 wt. % to about 5 wt. %, and in some embodiments, from about 0.8 wt. % to about 4 wt. % of the decolorizing composition. The cell lysing agent is believed to disrupt the membrane of red blood cells and thereby boost the ability of the peroxide to react with the hemoglobin and alter its color. One particularly suitable type of cell lysing agent is a surfactant, such as a nonionic, anionic, cationic, amphoteric and/or zwitterionic surfactant.

Suitable nonionic surfactants may include, for instance, alkyl polysaccharides, alcohol ethoxylates, block copolymers, castor oil ethoxylates, ceto-oleyl alcohol ethoxylates, cetearyl alcohol ethoxylates, decyl alcohol ethoxylates, dinonyl phenol ethoxylates, dodecyl phenol ethoxylates, end-capped ethoxylates, ether amine derivatives, ethoxylated alkanolamides, ethylene glycol esters, fatty acid alkanolamides, fatty alcohol alkoxylates, lauryl alcohol ethoxylates, mono-branched alcohol ethoxylates, nonyl phenol ethoxylates, octyl phenol ethoxylates, oleyl amine ethoxylates, random copolymer alkoxylates, sorbitan ester ethoxylates, stearic acid ethoxylates, stearyl amine ethoxylates, tallow oil fatty acid ethoxylates, tallow amine ethoxylates, tridecanol ethoxylates, acetylenic diols, polyoxyethylene sorbitols, and mixtures thereof. Various specific examples of suitable nonionic surfactants include, but are not limited to, methyl gluceth-10, PEG-20 methyl glucose distearate, PEG-20 methyl glucose sesquistearate, C11-15 pareth-20, ceteth-8, ceteth-12, dodoxynol-12, laureth-15, PEG-20 castor oil, polysorbate 20, steareth-20, polyoxyethylene-10 cetyl ether, polyoxyethylene-10 stearyl ether, polyoxyethylene-20 cetyl ether, polyoxyethylene-10 oleyl ether, polyoxyethylene-20 oleyl ether, an ethoxylated nonylphenol, ethoxylated octylphenol, ethoxylated dodecylphenol, or ethoxylated fatty ($C_6$-$C_{22}$) alcohol, including 3 to 20 ethylene oxide moieties, polyoxyethylene-20 isohexadecyl ether, polyoxyethylene-23 glycerol laurate, polyoxyethylene-20 glyceryl stearate, PPG-10 methyl glucose ether, PPG-20 methyl glucose ether, polyoxyethylene-20 sorbitan monoesters, polyoxyethylene-80 castor oil, polyoxyethylene-15 tridecyl ether, polyoxyethylene-6 tridecyl ether, laureth-2, laureth-3, laureth-4, PEG-3 castor oil, PEG 600 dioleate, PEG 400 dioleate, and mixtures thereof. Commercially available nonionic surfactants may include the SURFYNOL® range of acetylenic diol surfactants available from Air Products and Chemicals of Allentown, Pa.; the TWEEN® range of polyoxyethylene surfactants available from Fisher Scientific of Pittsburgh, Pa.; and the TRITON® range of polyoxyethylene surfactants (e.g., TRITON® X-100, polyoxyethylene-10 isooctylcyclohexyl ether) available from Sigma-Aldrich Chemical Co. of St. Louis, Mo.

Alkyl glycoside nonionic surfactants may also be employed and are generally prepared by reacting a monosaccharide, or a compound hydrolyzable to a monosaccharide, with an alcohol such as a fatty alcohol in an acid medium. For example, U.S. Pat. Nos. 5,527,892 and 5,770,543, which are incorporated herein in their entirety by reference thereto for all purposes, describe alkyl glycosides and/or methods for their preparation. Suitable examples are commercially available under the names of Glucopon™ 220, 225, 425, 600 and 625, PLANTACARE®, and PLANTAPON®, all of which are available from Cognis Corp. of Ambler, Pa. These products are mixtures of alkyl mono- and oligoglucopyranosides with alkyl groups based on fatty alcohols derived from coconut and/or palm kernel oil. Glucopon™ 220, 225 and 425 are examples of particularly suitable alkyl polyglycosides. Glucopon™ 220 is an alkyl polyglycoside that contains an average of 1.4 glucosyl residues per molecule and a mixture of 8 and 10 carbon alkyl groups (average carbons per alkyl chain-9.1). Glucopon™ 225 is a related alkyl polyglycoside with linear alkyl groups having 8 or 10 carbon atoms (average alkyl chain-9.1 carbon atoms) in the alkyl chain. Glucopon™ 425 includes a mixture of alkyl polyglycosides that individually include an alkyl group with 8, 10, 12, 14 or 16 carbon atoms (average alkyl chain-10.3 carbon atoms). Glucopon™ 600 includes a mixture of alkyl polyglycosides that individually include an alkyl group with 12, 14 or 16 carbon atoms (average alkyl chain 12.8 carbon atoms). Glucopon™ 625 includes a mixture of alkyl polyglycosides that individually include an alkyl group having 12, 14 or 18 carbon atoms (average alkyl chain 12.8 carbon atoms). Still other suitable alkyl glycosides are available from Dow Chemical Co. of Midland, Mich. under the Triton™ designation, e.g., Triton™ CG-110 and BG-10.

Exemplary anionic surfactants include alkyl sulfates, alkyl ether sulfates, alkyl ether sulfonates, sulfate esters of an alkylphenoxy polyoxyethylene ethanol, α-olefin sulfonates, β-alkoxy alkane sulfonates, alkylauryl sulfonates, alkyl monoglyceride sulfates, alkyl monoglyceride sulfonates, alkyl carbonates, alkyl ether carboxylates, alkyl phosphates, alkyl ether phosphates, sulfosuccinates, sarcosinates, octoxynol or nonoxynol phosphates, taurates, fatty acid amide polyoxyethylene sulfates, isethionates, or mixtures thereof. Particular examples of anionic surfactants include, but are not limited to, $C_8$-$C_{22}$ alkyl sulfates, $C_8$-$C_{22}$ fatty acid salts, $C_8$-$C_{22}$ alkyl ether sulfates having one or two moles of ethoxylation, $C_8$-$C_{22}$ alkyl ether phosphates having one to three moles of ethoxylation, $C_8$-$C_{22}$ alkoyl sarcosinates, $C_8$-$C_{22}$ sulfoacetates, $C_8$-$C_{22}$ sulfosuccinates, $C_8$-$C_{22}$ alkyl diphenyl oxide disulfonates, $C_8$-$C_{22}$ alkyl carbonates, $C_8$-$C_{22}$ alpha-olefin sulfonates, methyl ester sulfonates, and blends thereof. The $C_8$-$C_{22}$ alkyl group may be straight chain (e.g., lauryl) or branched (e.g., 2-ethylhexyl). The cation of the anionic surfactant may be an alkali metal (e.g., sodium or potassium), ammonium, $C_1$-$C_4$ alkylammonium (e.g., mono-, di-, tri-), or $C_1$-$C_3$ alkanolammonium (e.g., mono-, di-, tri). More specifically, such anionic surfactants may include, but are not limited to, lauryl sulfates, octyl sulfates, 2-ethylhexyl sulfates, potassium laureth phosphate, decyl sulfates, tridecyl sulfates, cocoates, lauroyl sarcosinates, lauryl sulfosuccinates, linear $C_{10}$ diphenyl oxide disulfonates, lauryl sulfosuccinates, lauryl ether sulfates (1 and 2 moles ethylene oxide), myristyl sulfates, cetyl sulfates, and similar surfactants.

Amphoteric and zwitterionic surfactants may also be employed, wherein at least one of the aliphatic substituents contains from about 8 to 22 carbon atoms and at least one of the aliphatic substituents contains an anionic water-solubilizing group, such as a carboxy, sulfonate, or sulfate group. Some examples of amphoteric surfactants include, but are not limited to, betaines, alkylamido betaines, sulfobetaines, N-alkyl betaines, sultaines, amphoacetates, amophodiacetates, imidazoline carboxylates, sarcosinates, acylamphoglycinates, such as cocamphocarboxyglycinates and acylamphopropionates, and combinations thereof. Additional classes of amphoteric surfactants include phosphobetaines and the phosphitaines. For instance, some examples of such amphoteric surfactants include, but are not limited to cocamidopropyl betaine, lauramidopropyl betaine, meadowfoamamidopropyl betaine, sodium cocoyl sarcosinate, sodium cocamphoacetate, disodium cocoamphodiacetate, ammonium cocoyl sarcosinate, sodium cocoamphopropionate, cocodimethylcarboxymethylbetaine, lauryldimethylcarboxymethylbetaine, lauryldimethylcarboxyethylbetaine, cetyldimethylcarboxymethylbetaine, lauryl-bis-(2-hydroxyethyl)carboxymethylbetaine, oleyldimethylgammacarboxypropylbetaine, lauryl-bis-(2-hydroxypropyl)-carboxyethylbetaine, cocoamidodimethylpropylsultaine, stearylamidodimethylpropylsultaine, laurylamido-bis-(2-hydroxyethyl)propylsultaine, cocoamido disodium 3-hydroxypropyl phosphobetaine, lauric myristic amido disodium 3-hydroxypropyl phosphobetaine, lauric myristic amido glyceryl phosphobetaine, lauric myristic amido carboxy disodium 3-hydroxypropyl phosphobetaine, cocoamido propyl monosodium phosphitaine, lauric myristic amido propyl monosodium phosphitaine, and mixtures thereof. Suitable zwitterionic surfactants include, for example, alkyl amine oxides, silicone amine oxides, and combinations thereof. Specific examples of suitable zwitterionic surfactants include, for example, 4-[N,N-di(2-hydroxyethyl)-N-octadecylammonio]-butane-1-carboxylate, S—[S-3-hydroxypropyl-S-hexadecylsulfonio]-3-hydroxypentane-1-sulfate, 3-[P,P-diethyl-P-3,6,9-trioxatetradexopcylphosphonio]-2-hydroxypropane-1-phosphate, 3-[N,N-dipropyl-N-3-dodecoxy-2-hydroxypropylammonio]-propane-1-phosphonate, 3-(N,N-dimethyl-N-hexadecylammonio) propane-1-sulfonate, 3-(N,N-dimethyl-N-hexadecylammonio)-2-hydroxypropane-1-sulfonate, 4-[N,N-di(2-hydroxyethyl)-N-(2-hydroxydodecyl)ammonio]-butane-1-carboxylate, 3-[S-ethyl-S-(3-dodecoxy-2-hydroxypropyl)sulfonio]-propane-1-phosphate, 3-[P,P-dimethyl-P-dodecylphosphonio]-propane-1-phosphonate, 5-[N,N-di(3-hydroxypropyl)-N-hexadecylammonio]-2-hydroxy-pentane-1-sulfate, and combinations thereof.

Cationic surfactants may also be employed in the present invention, such as quaternized amine ethoxylates, alkyl ammonium salts, polymeric ammonium salts, alkyl pyridinium salts, aryl ammonium salts, alkyl aryl ammonium salts, silicone quaternary ammonium compounds, and combinations thereof. Specific examples of cationic surfactants include behentrimonium chloride, stearalkonium chloride, distearalkonium chloride, chlorhexidine digluconate, polyhexamethylene biguanide (PHMB), polyaminopropyl biguanide, cetylpyridinium chloride, benzammonium chloride, benzalkonium chloride, and combinations thereof.

The rate at which peroxides decompose in an aqueous solution is dependent upon many factors, one of which includes the presence of various metallic impurities, such as iron, manganese, copper and chromium, which may catalyze the decomposition. Because the decolorizing composition is typically exposed to metallic impurities (e.g., calcium ions in water) during mixing, storage, or use, a metal chelating agent is employed in the present invention in an amount from about 0.05 wt % to about 10 wt. %, in some embodiments from about 0.1 wt. % to about 5 wt. %, and in some embodiments, from about 0.5 wt. % to about 4 wt. % of the stain-discharging composition. Without being limited by theory, it is believed that the metal chelating agent may regulate the exposure of the peroxide to such metal ions and thereby limit the premature release of active peroxide. The chelating agent may also help sequester iron from within heme groups to ensure the desired color change. The chelating agent may include, for instance, aminocarboxylic acids (e.g., ethylenediaminetetraacetic acid) and salts thereof, hydroxycarboxylic acids (e.g., citric acid, tartaric acid, ascorbic acid, etc.) and salts thereof, polyphosphoric acids (e.g., tripolyphosphoric acid, hexametaphosphoric acid, etc.) and salts thereof, and so forth. Desirably, the chelating agent is multidentate in that it is capable of forming multiple coordination bonds with metal ions to reduce the likelihood that any of the free metal ions will interact with the peroxide. In one embodiment, for example, a multidentate chelating agent containing two or more aminodiacetic (sometimes referred to as iminodiacetic) acid groups or salts thereof may be utilized Aminodiacetic acid groups generally have the following structure:

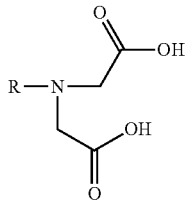

One example of such a chelating agent is ethylenediaminetetraacetic acid (EDTA), which has the following general structure:

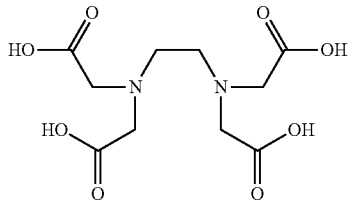

Examples of suitable EDTA salts include calcium disodium EDTA, diammonium EDTA, disodium and dipotassium EDTA, trisodium and tripotassium EDTA, tetrasodium and tetrapotassium EDTA. Still other examples of similar aminodiacetic acid chelating agents include, but are not limited to, butylenediaminetetraacetic acid, (1,2-cyclohexylenediaminetetraacetic acid (CyDTA), diethylenetriaminepentaacetic acid (DTPA), ethylenediaminetetrapropionic acid, (hydroxyethyl)ethylenediaminetriacetic acid (HEDTA), triethanolamine EDTA, triethylenetetraminehexaacetic acid (TTHA), 1,3-diamino-2-hydroxypropane-N,N,N',N'-tetraacetic acid (DHPTA), methyliminodiacetic acid, propylenediaminetetraacetic acid, ethylenediiminodipropanedioic acid (EDDM), 2,2'-bis(carboxymethyl)iminodiacetic acid (USA), ethylenediiminodibutandioic acid (EDDS), and so forth.

Still other suitable multidentate chelating agents include N,N,N',N'-ethylenediaminetetra(methylenephosphonie)acid (EDTMP), nitrilotrimethyl phosphonic acid, 2-aminoethyl dihydrogen phosphate, 2,3-dicarboxypropane-1,1-diphosphonic acid, meso-oxybis(butandionic acid) (ODS), and so forth.

Due to its strong oxidation potential in aqueous solutions, the peroxide compound can attack other components of the decolorizing composition (e.g., cell lysing agent). In this regard, the composition of the present invention also employs an antioxidant in an amount from about 0.0005 wt. % to about 5 wt. %, in some embodiments from about 0.001 wt. % to about 1 wt %, and in some embodiments, from about 0.005 wt. % to about 0.5 wt. % of the composition. Without intending to be limited by theory, it is believed that the reduction potential of the antioxidant allows it to act as a sacrificial material for oxidation by the peroxide, which allows the other components of the composition to function in their desired capacity in decolorizing a stain. Suitable antioxidants may include, for instance, acetylcysteine, ascorbic acid, alkyl ascorbic acid derivatives, 3-tert-butyl-4-hydroxyanisole, 2,6-di-tert-butyl-p-cresol, caffeic acid, chlorogenic acid, cysteine, cysteine hydrochloride, decyhnercaptomethyl-imidazole, diamylhydroquinone, dicetyl thiodipropionate, digalloyl trioleate, dilauryl thiodipropionate, dimyristyl thiodipropionate, dioleyl tocopheryl methylsilanol, disodium rutinyl disulphate, distearyl thiodipropionate, ditridecyl thiodipropionate, propyl gallate, dodecyl gallate, erythorbic acid, ethyl ferulate, ferulic acid, hydroquinone, p-hydroxyanisole, hydroxylamine hydrochloride, hydroxylamine sulphate, isooctyl thioglycolate, kojic acid, madecassicoside, methoxy-PEG-7-rutinyl succinate, nordihydroguaiaretic acid, octyl gallate, phenylthioglycolic acid, phloroglucinol, propyl gallate, rosmarinic acid, rutin, sodium erythorbate, sodium thioglycolate, sorbityl furfural, thiodiglycol, thiodiglycolamide, thiodiglycolic acid, thioglycolic acid, thiolactic acid, thiosalicylic acid, tocophereth-5, tocophereth-10, tocophereth-12, tocophereth-18, tocophereth-50, tocophersolan, tocopherol (e.g. vitamin E) and its derivatives (e.g. vitamin E derivatives such as vitamin E acetate, vitamin E linoleate, vitamin E nicotinate and vitamin E succinate), o-tolylbiguanide, tris(nonylphenyl)phosphite, alpha-hydroxycarboxylic acids (e.g. glycolic acid, lactic acid, mandelic acid) and salts thereof. Of these, tocopherols and their derivatives are particularly desirable and may act as physiologically active antioxidants, even in the cell membrane.

Besides those mentioned above, the decolorizing composition of the present invention may also contain a variety of other optional ingredients. For example, the decolorizing composition may contain a preservative or preservative system to inhibit the growth of microorganisms over an extended period of time. Suitable preservatives for use in the present compositions may include, for instance, Kathon CG®, which is a mixture of methylchloroisothiazolinone and methylisothiazolinone available from Rohm & Haas; Neolone 950®, which is methylisothiazolinone available from Rohm & Haas, DMDM hydantoin (e.g., Glydant Plus, Lonza, Inc., Fair Lawn, N.J.); iodopropynyl butylcarbamate; benzoic esters (parabens), such as methylparaben, propylparaben, butylparaben, ethylparaben, isopropylparaben, isobutylparaben, benzylparaben, sodium methylparaben, and sodium propylparaben; 2-bromo-2-nitropropane-1,3-diol; benzoic acid; imidazolidinyl urea; diazolidinyl urea; and the like. Still other preservatives may include ethylhexylglycerin (Sensiva SC 50 by Schulke & Mayr), phenoxyethanol (Phenoxyethanol by Tri-K Industries), caprylyl glycol (Lexgard O by Inolex Chemical Company, Symdiol 68T (a blend of 1,2-hexanediol, caprylyl glycol and tropolone by Symrise) and Symocide PT (a blend of phenoxyethanol and tropolone by Symrise).

The stain-discharging composition may also include various other components as is well known in the art, such as binders, humectants, colorants, biocides or biostats, electrolytic salts, pH adjusters, etc. Examples of suitable humectants include, for instance, ethylene glycol; diethylene glycol; glycerin; polyethylene glycol 200, 400, and 600; propane-1,3-diol; sorbitol; sodium PCA; hyaluronic acid; propylene glycol; butylene glycol; propylene-glycolmonomethyl ethers, such as Dowanol PM (Gallade Chemical Inc., Santa Ana, Calif.); polyhydric alcohols; or combinations thereof.

To form the stain-discharging composition, its components are first typically dissolved or dispersed in a polar solvent (e.g., water). For example, one or more of the above mentioned components may be mixed with the solvent, either sequentially or simultaneously, to form the stain-discharging composition. Although the actual concentration of the solvent employed will generally depend on the nature of the stain-discharging composition and its components, it is nonetheless typically present in an amount from about 50 wt % to about 99.9 wt. %, in some embodiments from about 60 wt. % to about 99 wt. %, and in some embodiments, from about 75 wt. % to about 98 wt. % of the stain-discharging composition.

The method of delivering the stain-discharging composition of the present invention to a stain is not critical so long as an effective amount of the peroxide is delivered. For example, the stain-discharging composition may be provided in the form of a pump or aerosol spray, gel, stick, cream, lotion, etc. Alternatively, the stain-discharging composition may be applied to a solid support for subsequent contact with a stain. The nature of the solid support may vary depending on the intended use, and may include materials such as films, paper, nonwoven webs, knitted fabrics, woven fabrics, foam, glass, etc. Desirably, the solid support is a wipe configured for use on clothing articles or other surfaces, such as a baby wipe, adult wipe, hand wipe, face wipe, cosmetic wipe, household wipe, industrial wipe, personal cleansing wipe, cotton ball, cotton-tipped swab, and so forth.

The wipe may be formed from any of a variety of materials as is well known in the art. For example, the wipe may include a nonwoven web that contains an absorbent material of sufficient wet strength and absorbency for use in the desired application. For example, the nonwoven web may include absorbent fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and so forth. Exemplary commercially available pulp fibers suitable for the present invention include those available from Weyerhaeuser under the trade designation "Fluff Pulp". Hardwood fibers, such as eucalyptus, maple, birch, aspen, and so forth, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other absorbent fibers that may be used in the present invention, such as abaca, sabai grass, milkweed floss, pineapple leaf, cellulosic esters, cellulosic ethers, cellulosic nitrates, cellulosic acetates, cellulosic acetate butyrates, ethyl cellulose, regenerated celluloses (e.g., viscose or rayon), and so forth.

Synthetic thermoplastic fibers may also be employed in the nonwoven web, such as those formed from polyolefins, e.g., polyethylene, polypropylene, polybutylene, etc.; polytetrafluoroethylene; polyesters, e.g., polyethylene terephthalate and so forth; polyvinyl acetate; polyvinyl chloride acetate; polyvinyl butyral; acrylic resins, e.g., polyacrylate, polymethylacrylate, polymethylmethacrylate, and so forth; polyamides, e.g., nylon; polyvinyl chloride; polyvinylidene chloride; polyvinylidene fluoride; polystyrene; polyvinyl alcohol; polyurethanes; polylactic acid; copolymers thereof; and so forth. Because many synthetic thermoplastic fibers are inherently hydrophobic (i.e., non-wettable), such fibers may optionally be rendered more hydrophilic (i.e., wettable) by treatment with a surfactant solution before, during, and/or after web formation. Other known methods for increasing wettability may also be employed, such as described in U.S. Pat. No. 5,057,361 to Sayovitz, et al., which is incorporated herein in its entirety by reference thereto for all purposes.

If desired, the nonwoven web material may be a composite that contains a combination of synthetic thermoplastic polymer fibers and absorbent fibers, such as polypropylene and pulp fibers. The relative percentages of such fibers may vary over a wide range depending on the desired characteristics of the nonwoven composite. For example, the nonwoven composite may contain from about 1 wt. % to about 60 wt. %, in some embodiments from 5 wt % to about 50 wt. %, and in some embodiments, from about 10 wt. % to about 40 wt. % synthetic polymeric fibers. The nonwoven composite may likewise contain from about 40 wt. % to about 99 wt. %, in some embodiments from 50 wt. % to about 95 wt. %, and in some embodiments, from about 60 wt. % to about 90 wt % absorbent fibers.

Nonwoven composites may be formed using a variety of known techniques. For example, the nonwoven composite may be a "coform material" that contains a mixture or stabilized matrix of thermoplastic fibers and a second non-thermoplastic material. As an example, coform materials may be made by a process in which at least one meltblown die head is arranged near a chute through which other materials are added to the web while it is forming. Such other materials may include, but are not limited to, fibrous organic materials such as woody or non-woody pulp such as cotton, rayon, recycled paper, pulp fluff and also superabsorbent particles, inorganic and/or organic absorbent materials, treated polymeric staple fibers and so forth. Some examples of such coform materials are disclosed in U.S. Pat. No. 4,100,324 to Anderson, et al.; U.S. Pat. No. 5,284,703 to Everhart, et al.; and U.S. Pat. No. 5,350,624 to Georger, et al.; which are incorporated herein in their entirety by reference thereto for all purposes. Alternatively, the nonwoven composite may be formed by hydraulically entangling fibers and/or filaments with high-pressure jet streams of water. Hydraulically entangled nonwoven composites of staple length fibers and continuous filaments are disclosed, for example, in U.S. Pat. Nos. 3,494,821 to Evans and U.S. Pat. No. 4,144,370 to Bouolton, which are incorporated herein in their entirety by reference thereto for all purposes. Hydraulically entangled nonwoven composites of a continuous filament nonwoven web and pulp fibers are disclosed, for example, in U.S. Pat. Nos. 5,284,703 to Everhart, et al. and U.S. Pat. No. 6,315,864 to Anderson, et al., which are incorporated herein in their entirety by reference thereto for all purposes.

Regardless of the materials or processes utilized to form the wipe, the basis weight of the wipe is typically from about 20 to about 200 grams per square meter (gsm), and in some embodiments, between about 35 to about 100 gsm. Lower basis weight products may be particularly well suited for use as light duty wipes, while higher basis weight products may be better adapted for use as industrial wipes. The wipe may assume a variety of shapes, including but not limited to, generally circular, oval, square, rectangular, or irregularly shaped. Each individual wipe may be arranged in a folded configuration and stacked one on top of the other to provide a stack of wet wipes. Such folded configurations are well known to those skilled in the art and include c-folded, z-folded, quarter-folded configurations and so forth. For example, the wipe may have an unfolded length of from about 2.0 to about 80.0 centimeters, and in some embodiments, from about 10.0 to about 25.0 centimeters. The wipes may likewise have an unfolded width of from about 2.0 to about 80.0 centimeters, and in some embodiments, from about 10.0 to about 25.0 centimeters. The stack of folded wipes may be placed in the interior of a container, such as a plastic tub, to provide a package of wipes for eventual sale to the consumer. Alternatively, the wipes may include a continuous strip of material which has perforations between each wipe and which may be arranged in a stack or wound into a roll for dispensing. Various suitable dispensers, containers, and systems for delivering wipes are described in U.S. Pat. No. 5,785,179 to Buczwinski, et al.; U.S. Pat. No. 5,964,351 to Zander; U.S. Pat. No. 6,030,331 to Zander; U.S. Pat. No. 6,158,614 to Haines, et al.; U.S. Pat. No. 6,269,969 to Huang, et al.; U.S. Pat. No. 6,269,970 to Huang, et al.; and U.S. Pat. No. 6,273,359 to Newman, et al., which are incorporated herein in their entirety by reference thereto for all purposes.

In certain embodiments of the present invention, the stain-discharging composition is incorporated into a wet wipe solution for application to the wipe. The stain-discharging solution may, if desired, include other components for cleaning, disinfecting, sanitizing, etc., such as described in U.S. Pat. Nos. 6,440,437 to Krzysik, et al.; U.S. Pat. No. 6,028,018 to Amundson, et al.; U.S. Pat. No. 5,888,524 to Cole; U.S. Pat. No. 5,667,635 to Win, et al.; and U.S. Pat. No. 5,540,332 to Kopacz, et al., which are incorporated herein in their entirety by reference thereto for all purposes. The stain-discharging may be applied using any suitable method known in the art, such as spraying, dipping, saturating, impregnating, brush coating, and so forth. The amount of the stain-discharging solution employed may vary depending upon the type of wipe material utilized, the type of container used to store the wipes, the nature of the stain-discharging formulation, and the desired end use of the wipes. Generally, each wipe contains from about 150 wt % to about 600 wt. %, in some embodiments from about 200 wt. % to about 550 wt. %, and in some embodiments, from about 300 wt. % to about 500 wt. % of a stain-discharging solution based on the dry weight of the wipe.

According to the present invention, a stain that is treated with the stain-discharging composition can be discharged or neutralized within a period of about 30 minutes or less, in some embodiments about 15 minutes or less, and in some embodiments, about 5 minutes or less. The resulting color change may be observed visually or detected with an optical reader, such as one that relies upon colorimetry as described below.

The present stain-discharging compositions could contain one or a combination or multiple solvents (or liquid medium), but a desirable embodiment is a single solvent (water). According to a desired embodiment, the ingredients are all mixed together in water, and the ingredients can all be mixed together stably. As certain ingredients are not compatible with hydrogen peroxide, in other embodiments, the ingredients of the formulation could be stored in multiple chambers of a dispenser until just before use, when they can be mixed together before dispensing. For instance, if an embodiment incorporated a cell lysing agent that was not compatible with peroxide, the formulation still would be stable by separating those two components until ready to be dispensed.

The present invention may be better understood with reference to the examples listed in accompanying figures and tables of the following examples.

Test Methods

Aging was performed on 4.5 gram liquid samples and wipes loaded with 330% add-on level of the formulation. The liquid samples were placed in 40° C. and 50° C. ovens as well as kept at room temperature with pull points at 1 week, 2 weeks, 4 weeks, 6 weeks and 8 weeks. The wipes were wetted, compressed to make sure that the wipes take up the fluid (i.e., rolled like with a rolling pin), wrapped in tin foil with the seams taped, placed into a sealable plastic bag and placed in the ovens, and at room temperature. After aging, hydrogen peroxide ($H_2O_2$) concentration was analytically detected using conventional techniques. More specifically, a titanium salt was added to the test solutions to induce a color change. The absorbance reading of the resulting sample was then detected via spectrophotometry, wherein the intensity of the reading was proportional to $H_2O_2$ concentration.

I.

The ability to form a stable peroxide decolorizing composition is demonstrated. Two decolorizing example formulations were tested under three different conditions, for a total of twelve decolorizing samples. Samples 1-6 were formed with a composition as set forth below in Table 1.

TABLE 1

Composition of Samples 1-6

| Component | % by Weight in Formula |
|---|---|
| Water | 98.1 |
| Potassium Laureth Phosphate | 0.60 |
| Polysorbate 20 | 0.30 |
| Tetrasodium EDTA | 0.20 |
| Tocopheryl Acetate | 0.001 |
| Hydrogen Peroxide | 0.60 |
| Preservatives and additional non-active components | 0.199 |

Samples 1-3 are liquid samples prepared by adding the components of the formulation to a beaker and mixing until homogenous. In Samples 4-6, the composition liquid is expressed on coform wipes. In particular, about 4.5 grams of the formulation was placed into several small vials (enough for 1 per pull point per sample) and placed at the appropriate temperature for evaluation. The coform wipe samples (enough for 1 wipe per pull point) are applied with a solution at 330% of the dry weight, wrapped in foil with the seams taped, placed in a plastic bag and added to the appropriate temperature environment (40° C., 50° C. or room temp). Once formed, Samples 1-6 were aged at various temperatures (ambient temperature, 40° C., and 50° C.) as described above. The results are set forth below in Table 2.

TABLE 2

Hydrogen Peroxide Concentration of Aged Samples

| | | | After 1 week | | After 2 weeks % | | After 4 weeks | |
|---|---|---|---|---|---|---|---|---|
| Sample | Aging Temperature (° C.) | % $H_2O_2$ in Solution (initial) | $H_2O_2$ in Solution | % % of Initial | $H_2O_2$ in Solution | % of Initial | % $H_2O_2$ in Solution | % of Initial |
| 1 | Room | 0.68% | 0.62% | 91% | 0.67% | 99% | 0.58% | 85% |
| 2 | 40 | 0.68% | 0.58% | 85% | 0.63% | 93% | 0.55% | 81% |
| 3 | 50 | 0.68% | 0.56% | 82% | 0.54% | 79% | 0.41% | 60% |
| 4 | Room | 0.66% | 0.63% | 95% | 0.68% | 103% | 0.67% | 102% |
| 5 | 40 | 0.57% | ** | ** | 0.51% | 89% | ** | ** |
| 6 | 50 | 0.42% | ** | ** | 0.13% | 31% | ** | ** |

** Samples too dry to extract any solution.

II.

Samples 7-16 are formed according to the composition set forth below in Tables 3 and 4.

TABLE 3

Composition of Samples 7-11

| Component | % by Weight in Formula |
|---|---|
| Water | 95.4 |
| Sodium Lauryl Sulfate | 0.60 |
| Tetrasodium EDTA | 2 |
| Urea Hydrogen Peroxide Adduct | 2 |

TABLE 4

| Composition of Samples 12-16 | |
|---|---|
| Component | % by Weight in Formula |
| Water | 96.8 |
| Sodium Lauryl Sulfate | 0.60 |
| Tetrasodium EDTA | 2 |
| Hydrogen Peroxide | 0.60 |

Samples 7-11 were liquid samples prepared by adding the components of the formulation to a beaker and mixing until homogenous. Samples 12-16 were coform wipe samples, and (enough for 1 wipe per pull point) are applied with a solution at 330% of the dry weight, wrapped in foil with the seams taped, placed in a plastic bag and added to the appropriate temperature environment (40° C., 50° C. or room temp). Once formed, Samples 7-16 were aged at various temperatures (ambient temperature, 40° C., and 50° C.) as described above. The results are set forth below in Table 5.

TABLE 5

| Hydrogen Peroxide Concentration of Aged Samples | | | | | | |
|---|---|---|---|---|---|---|
| | Aging | % $H_2O_2$ in | After 1 week | | After 2 weeks | |
| Sample | Temperature (° C.) | Solution (initial) | % $H_2O_2$ in Solution | % of Initial | % $H_2O_2$ in Solution | % of Initial |
| 7 | Room | 0.54% | 0.37% | 69% | 0.35% | 65% |
| 8 | 40 | 0.54% | 0.17% | 31% | 0.09% | 13% |
| 9 | 50 | 0.54% | <0.02% | <4% | <0.02% | <4% |
| 10 | 40 | 0.68% | 0.09% | 13% | 0.05% | 7.4% |
| 11 | 50 | 0.68% | <0.02% | <4% | 0.06% | 8.8% |
| 12 | Room | 0.34% | 0.10% | 29% | 0.07% | 21% |
| 13 | 40 | 0.34% | 0.03% | 8.8% | <0.02% | <4% |
| 14 | 50 | 0.34% | <0.02% | <4% | <0.02% | <4% |
| 15 | 40 | 0.36% | 0.03% | 8.3% | 0.04% | 11% |
| 16 | 50 | 0.54% | <0.02% | <4% | ** | — |

** Samples too dry to extract any solution.

As indicated in Table 5, the stability of the samples formed without an antioxidant (Samples 7-16) was not as good as the samples formed with an antioxidant (Samples 1-6, Table 4).

B.—Color Measurement

In measuring color, a person certainly can evaluate the relative shades and hues of color by means of comparison using the naked eye. For an objective standard, however, a method of evaluation that provides the observer with numerical data along with a process to quantify that data is needed using a spectrophotometer, and a color interpretation method: Delta-E (ΔE). Color intensity and change may be measured using a conventional test known as "CIELAB", which is discussed in *Pocket Guide to Digital Printing* by F. Cost, Delmar Publishers, Albany, N.Y. ISBN 0-8273-7592-1, at pages 144 and 145, the contents of which are incorporated herein by reference. This method defines three variables, L*, a*, and b*, which correspond to three characteristics of a perceived color based on the opponent theory of color perception. The three variables have the following meaning:

L*=Lightness (or luminosity), ranging from 0 to 100, where 0=dark and 100=light;

a*=Red/green axis, ranging approximately from −100 to 100; positive values are reddish and negative values are greenish; and b*=Yellow/blue axis, ranging approximately from −100 to 100; positive values are yellowish and negative values are bluish.

Because CIELAB color space is somewhat visually uniform, a single number may be calculated that represents the difference between two colors as perceived by a human. This difference is termed ΔE and calculated by taking the square root of the sum of the squares of the three differences (ΔL*, Δa*, and Δb*) between the two colors.

In CIELAB color space, each ΔE unit is approximately equal to a "just noticeable" difference between two colors. CIELAB is therefore a good measure for an objective device-independent color specification system that may be used as a reference color space for the purpose of color management and expression of changes in color. Using this test, color intensities (L*, a*, and b*) may thus be measured using, for instance, a handheld spectrophotometer from Minolta Co. Ltd. of Osaka, Japan (Model #CM2600d). This instrument utilizes the D/8 geometry conforming to CIE No. 15, ISO 7724/1, ASTME1164 and JIS Z8722-1982 (diffused illumination/8-degree viewing system. The D65 light reflected by the specimen surface at an angle of 8 degrees to the normal of the surface is received by the specimen-measuring optical system. Still other suitable devices for measuring the intensity of a visual color may also be used in the present invention. For example, a suitable reflectance reader is described in U.S. Patent App. Pub. No. 2003/0119202 to Kaylor, et al., the content of which is incorporated herein in by reference.

In accompanying FIG. 3, stained undergarments are cleaned using the present stain-discharging formulation and method (FIG. 3A) and competitive commercial cleaning solutions (FIG. 3B-D). One can see the contrast between the effectiveness of stain removal in FIG. 3A, where the stain is completely gone, and the other panels in FIG. 3B-D, in which there is still shadow or worse of the stain. Although the present composition completely removes the stain from the textile substrate when treated, an observer during the course of cleaning sees the invention produce a color change in which the color of the stain is reduced by a ΔE value ≥5. Generally, the color of the stain is reduced by at least a ΔE value of 15, but more than 20-30 is typical; often by about a ΔE value of ≥40 or 50.

The colorant or stain is discharged within a period of about 30 minutes or less after treatment, but typically becomes visually indistinguishable by the naked eye under about 10-15 minutes, or most desirably under about 3-5 minutes.

C.—Method and Kit

According to another aspect of the present invention, we have developed a rather effective method for discharging a stain from a textile substrate. The method optimizes the stain removal potential of the stain-discharging composition described in U.S. patent application Ser. No. 11/847,549, but appears to be even more effective with the present composition with higher relative viscosity. Generally, the method comprises: providing a textile substrate that has an organic colorant or stain on a first facing; applying an absorbent substrate against a side of said textile substrate either directly in contact said first facing with the stain or on a second facing behind or opposite from said stain; treating with a stain-discharging composition the side of said textile substrate opposite of said absorbent substrate, such that said stain-discharging composition is drawn through the textile substrate along with the stain into said absorbent substrate.

One may use a dispenser filled with the present stain-discharging composition. The dispenser must be capable of containing a water-thin liquid without leakage and of withstanding the amount of hydrogen peroxide in the formulation without degradation of the material that the dispenser is made of. Ideally, the dispenser would also be capable of a direct spot application and providing agitation to the stain as the composition is dispensed. These dispensers could include, but not be limited to: tubes, bottles, roller balls, or pen-type applicators. A common material inert to hydrogen peroxide would be high-density polyethylene (HDPE), although there are others available on the marketplace that would be adequate for creation of the dispenser.

The absorbent material should be able to absorb fluid and retain its form during the cleaning process. The material may have a barrier of some sort on one side of it to protect a user's hands from fluids during cleaning, such as a plastic or foil layer. Ideally, the absorbent material would be able to be disposed of following treatment, as blood stains are messy and unhygienic. The absorbent substrate can be selected from a variety of different fabric or textiles, for instance, cotton or microfiber textiles, absorbent sponges (natural or synthetic), absorbent foams, any dry basesheet technology that is currently used in wet wipes (coform, airlaid, spunlace, meltblown, hydroknit, etc.), paper toweling (of which many kinds are available), superabsorbent material alone or incorporated into another technology listed previously. Based on absorbing water from cotton textiles, since cotton is the most common fabric used for underwear or other clothing, and is difficult to blot or dab dry. The following textile varieties are more desirable and suitable absorbent substrate types: including a cellulose airlaid substrate with about 50-60% superabsorbent homogeneous mixed in; a coform, hydroknit, or cotton spunlace substrate that is either bleached or unbleached; a commercially available 100% cotton quilted squares, such as for use in cosmetics applications; and combinations of the foregoing in a laminated structure.

The method, according to one embodiment, makes use of the described stabilized stain-discharging composition contained within an appropriate applicator, dispenses the composition and rubs it onto a stained textile on the first, or front side, of the stain and applying an absorbent material from a second, opposing or backside of the stain textile substrate, which is changed or moved to a clean, dry area as the absorbent material becomes soiled from the stain or reaches its absorption maximum capacity. This method of use draws the cleaning solution (either as a liquid, gel or paste depending on the particular low or high viscosity of the material) through the textile fabric of a garment and into the absorbent material aiding cleaning in several ways. First, the method of use facilitates cleaning by solvating and drawing some of the blood stain away from the fibers of the garment and into the absorbent substrate. This actively removes part of the stain physically from within the garment, leaving less staining material to decolorize. Second, the method of use helps stain removal by keeping the travel and flow of active agents in the stain-discharging composition relatively short through the textile. That is, for example, by placing the affected area of a garment over the absorbent substrate one can pull the discoloration of the stain vertically from the topside of the stain to the bottom side of the stain while minimizing lateral, or horizontal, fluid movement, or movement of fluid from the stain site to unstained sites on the garment immediately adjacent to the stain site. Third, as the absorbent substrate material reaches its maximum absorbent capacity in one area, according to the method, one can adjust the absorbent substrate, moving to expose the garment to another clean dry area so as to prevent the garment from reabsorbing the stained or colored fluids.

In another example, the absorbent material is placed in the open palm of the hand and is maneuvered so that it rests in contact with the backside of the stain. With the other hand, the stabilized decolorizing composition is applied to the front side of the stain with agitation using the dispenser. As the absorbent material is soiled, it is moved so that a clean area of the absorbent material is in contact with the backside of the stain and treatment continues. This dispensing with agitation and movement of absorbent material is continued until the stain is completely removed. Following treatment, the garment can continue to be worn, or be laundered as normal.

The method shows superior cleaning, specifically on menstrual blood stains, and quickly removes stains that are wet and dried on. From empirical trials using various dispensers, dispensing types, and cleaning protocols, the present method and compositions appeared to clean more quickly and completely than the stabilized decolorizing composition in other forms. For example, the following methodologies were explored: two wet wipes loaded with a 330% add-on level of the stabilized decolorizing composition rubbed on the front and backside of the stain. The cleaning method and stain-discharging composition can remove stains typically within about one to three minutes. In some instances, as quickly as thirty seconds the stain is removed completely.

A second set of experiments demonstrated the cleaning efficacy of the present stain-discharging composition and cleaning method. FIG. 3 shows a series of photos taken of cotton undergarments that have been similarly stained and treated with representative examples of the present inventive composition and cleaning system and other competitive on-the-go cleaning products and methods currently available commercially. FIG. 3A shows the garment after being treated with the present invention for about 1-2 minutes. FIGS. 3B, 3C and 3D are images of garments treated with the competitive products and methods after about 3 minutes. As one can see, the present composition and method of stain removal again delivers superior cleaning ability (or effectiveness), more quickly (~1:30 vs. ~3:00 minutes) and completely than all of the current competitive products and prior methodologies tested.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

We claim:

1. A method for discharging a stain from a textile substrate, the method comprising: providing a textile substrate that has an organic colorant or stain on a first facing; applying an absorbent substrate against a side of said textile substrate either directly in contact to said first facing with the stain or on a second facing behind or opposite from said stain; and treating with a stain-discharging composition the side of said textile substrate opposite of said absorbent substrate, such that said stain-discharging composition is drawn through said textile substrate with the stain into said absorbent substrate, wherein the stain-discharging composition comprises from about 0.1 wt. % to 0.68 wt. % of at least one peroxide, from about 0.1 wt. % to 0.9 wt. % at least one cell lysing agent, a polar solvent, an antioxidant, a chelating agent, and a non-acrylate thickening agent.

2. The method according to claim 1, further comprising mechanically abrading or physically agitating the textile substrate or stain either during or after the treating step.

3. The method according to claim 2, further comprises using a device to physically agitate the stain.

4. The method according to claim 1, wherein said stain-discharging composition further comprises: from about 0.05 wt. % to about 10 wt. % of at least one chelating agent, from about 0.0005 wt. % to about 5 wt. % of at least one antioxidant, from about 0.001 wt. % to about 10 wt. % of the non-acrylate thickening agent, and from about 50 wt. % to about 99.9 wt. % of least one polar solvent.

5. The method according to claim 1, wherein the non-acrylate thickening agent includes a clay, starch, cellulose, gum, or a combination thereof.

6. The method according to claim 1, wherein the textile substrate is permeable to a liquid.

7. The method according to claim 1, wherein said stain is situated between said absorbent substrate and a source direction from which treatment is applied.

8. The method according to claim 1, wherein said method produces an observable color change in which the color of a stain is reduced by a $\Delta E$ value $\geq 5$.

9. The method according to claim 8, wherein the color of the stain is reduced by at least a $\Delta E$ value of 15.

10. The method according to claim 1, wherein said colorant or stain is discharged within a period of about 30 minutes after treatment.

11. The method according to claim 1, wherein said colorant or stain is discharged within 15 minutes after treatment.

* * * * *